US011448008B2

(12) United States Patent
Lei et al.

(10) Patent No.: US 11,448,008 B2
(45) Date of Patent: Sep. 20, 2022

(54) CURTAIN WINDING DEVICE

(71) Applicant: Leafy Windoware Co., Ltd., Dongguan (CN)

(72) Inventors: Zhenbang Lei, Dongguan (CN); Xingbang Lei, Dongguan (CN)

(73) Assignee: Leafy Windoware Co., Ltd., Dongguan (CN)

( * ) Notice: Subject to any disclaimer, the term of this patent is extended or adjusted under 35 U.S.C. 154(b) by 191 days.

(21) Appl. No.: 16/546,316

(22) Filed: Aug. 21, 2019

(65) Prior Publication Data

US 2021/0040794 A1 Feb. 11, 2021

(30) Foreign Application Priority Data

Aug. 7, 2019 (CN) ..... 201921282619.0

(51) Int. Cl.
*E06B 9/322* (2006.01)
*B65H 75/44* (2006.01)

(52) U.S. Cl.
CPC ..... *E06B 9/322* (2013.01); *B65H 75/4492* (2013.01)

(58) Field of Classification Search
CPC ..... E06B 9/322; E06B 2009/285; E06B 2009/3225; E06B 9/30; E06B 9/304; E06B 9/32; E06B 2009/3227; B65H 75/4492
See application file for complete search history.

(56) References Cited

U.S. PATENT DOCUMENTS 5,103,888 A * 4/1992 Nakamura ..... E06B 9/308 160/171
5,328,113 A * 7/1994 de Chevron Villette ..... E06B 9/308 242/388
6,158,494 A * 12/2000 Huang ..... E06B 9/262 160/171
7,287,569 B2 * 10/2007 Lin ..... E06B 9/303 160/170
2003/0168186 A1 * 9/2003 Wen ..... E06B 9/322 160/168.1 P
2004/0016517 A1 * 1/2004 Anderson ..... E06B 9/322 160/173 R
2004/0261956 A1 * 12/2004 Nien ..... E06B 9/322 160/176.1 R
2005/0109472 A1 * 5/2005 Lin ..... E06B 9/322 160/171
2006/0118248 A1 * 6/2006 Anderson ..... E06B 9/80 160/84.04

(Continued)

*Primary Examiner* — Johnnie A. Shablack
*Assistant Examiner* — Matthew R. Shepherd

(57) ABSTRACT

A curtain winding device includes a beam, a power mechanism mounted to the beam, a transmission rod driven by the power mechanism to rotate, and two reels fitted about the transmission rod and relatively fixed with the transmission rod in a circumferential direction. Each reel is wound with a drawstring. A drawstring holder is disposed on the beam to guide the drawstring to be wound on the reel. The beam is fixed with a nut. Each reel includes a screw segment screwed to the nut, and a cone segment gradually increasing in an outer diameter along an extending direction. An end of the reel away from the screw segment is provided with a fixing portion for fixing a distal end of the drawstring, and a positioning portion protruding from an outer side surface of the reel to abut against the drawstring holder to position an initial position of the reel.

6 Claims, 6 Drawing Sheets

(56) References Cited

U.S. PATENT DOCUMENTS

| | | | | |
|---|---|---|---|---|
| 2006/0237571 | A1* | 10/2006 | Hsu | B65H 75/48 242/377 |
| 2007/0169898 | A1* | 7/2007 | Lin | E06B 9/322 160/171 |
| 2009/0020239 | A1* | 1/2009 | Yu | E06B 9/322 160/331 |
| 2012/0073765 | A1* | 3/2012 | Hontz | E06B 9/304 160/84.02 |
| 2017/0298687 | A1* | 10/2017 | Chen | E06B 9/322 |
| 2019/0292848 | A1* | 9/2019 | Whitmire | E06B 9/74 |

* cited by examiner

CURTAIN WINDING DEVICE

BACKGROUND OF THE INVENTION

1. Field of the Invention

The present invention relates to the technical field of curtain accessories and, more particularly to a curtain winding device.

2. Description of Related Art

A curtain winding device is used to retract or release a drawstring to achieve control of a curtain body for shielding a window. A current curtain winding device includes a reel for winding the drawstring thereon, a power mechanism, and a transmission rod connected between an output of the power mechanism and the reel. A winding portion of a traditional reel is straight, and the transmission rod extends through the reel and is fixed in a circumferential direction with the reel. The power mechanism drives the reel to rotate through the transmission rod to wind the drawstring on the reel, and can correspondingly realize the rise of the curtain body, so that the window is opened. In order to keep the curtain body smoothly moving up and down, usually at least two drawstrings are symmetrically worn on the curtain body, and accordingly, a reel is separately provided for each drawstring to retract or release the drawstring. However, when assembling the reel, there may be a deviation in position or angle, which makes it difficult to ensure the synchronism of the reels, and which may cause the progresses of the retraction or releasing of the drawstrings on different reels to be inconsistent, resulting in deflection of the curtain body during the lifting or falling process of the curtain body. In addition, during the rising (gradual gathering) of the curtain body, the force of the curtain body acting on the power mechanism is gradually increased, and when the curtain body is lowered (gradually expanding), the force of the curtain body acting on the power mechanism is gradually reduced. Therefore, it is necessary to adopt a power mechanism that can also change the torque synchronously, in order to effectively maintain the normal rise and fall of the curtain body, but the power mechanism with the variable torque is relatively costly.

SUMMARY OF THE INVENTION

Therefore, the technical problem to be solved by the embodiments of the present invention is to provide a curtain winding device, which is capable of smoothly retracting or releasing a curtain body.

To solve the above-mentioned technical problems, an embodiment of the present invention provides a curtain winding device including a beam, a power mechanism mounted to the beam, a transmission rod driven by the power mechanism to rotate, and at least two reels fitted about the transmission rod and relatively fixed with the transmission rod in a circumferential direction. Each of the at least two reels is wound with a drawstring. A drawstring holder is disposed on the beam corresponding to each of the at least two reels to guide the drawstring to be wound on the corresponding reel. The beam is fixed with a nut corresponding to each of the at least two reels. Each of the at least two reels includes a screw segment screwed to the nut on the beam, and a cone segment extending from an end of the screw segment and gradually increasing in an outer diameter along an extending direction. An end of the reel away from the screw segment is provided with a fixing portion for fixing a distal end of the drawstring, and a positioning portion that protrudes from an outer side surface of the reel to abut against the drawstring holder to position an initial position of the reel.

Furthermore, each of the at least two reels further includes a straight segment extending from an end of the cone segment away from the screw segment. An outer diameter of the straight segment is equal to a maximum outer diameter of the cone segment. The fixing portion and the positioning portion are both disposed on an end of the straight segment away from the cone segment.

Furthermore, outer surfaces of the straight segment and the cone segment are integrally connected to form a first external thread. The first external thread is connected to a second external thread formed on an outer surface of the screw segment and screwed to the nut. After the drawstring is fixed to the fixing portion through the distal end, the drawstring is wound on the reel along threaded grooves of the first thread and the second thread.

Furthermore, the beam is fixed with a base one-to-one correspondence with each of the at least one reels. Opposite ends of the base are respectively fixed with the nut, and a blocking plate for defining an axial movement stroke of the reel. The reel is disposed between the nut and the blocking plate, in parallel with the base, and is screwed to the nut through the screw segment.

Furthermore, a middle of the base is provided with a drawstring holder. The drawstring holder protrudes toward the reel with respect to the middle of the base. The drawstring holder is provided with a drawstring hole through which the drawstring extends, and a drawstring wheel that guides an extending direction of the drawstring.

Furthermore, the blocking plate defines a passage through which the transmission rod extends.

Furthermore, a thickness of the portioning portion in the axial direction of the reel and the abutting position of the positioning portion on the drawstring holder are set such that the positioning portion and the drawstring holder are displaced from each other after the reel is rotated one rotation from the initial position.

Furthermore, the power mechanism includes a housing, a spring shaft and an output shaft rotatably disposed in the housing in parallel with each other, and a scroll spring that is wound on the spring shaft and has an outer end fixed to the output shaft to output a constant torque. The output shaft and the transmission rod are in drive connection.

By adopting the above-mentioned technical solutions, the beneficial effects of the inventive embodiment of the present invention are as follows. The curtain winding device provided by the embodiments of the present disclosure screws the reel to the nut on the beam through the screw segment. When the reel is rotated by the driving force of the power mechanism or an external pulling force, the reel can move in the axial direction with respect to the nut, thereby causing the drawstring to be retracted or released relative to the reel. The end of the reel is further provided with the positioning portion, so that each reel can be rotated to abut against the drawstring holder through the positioning portion at the time of assembly, thereby synchronizing the initial positions of the reels. On the basis of synchronizing the initial positions of the reels, the drawstrings are further wound or unwound, and it can be ensured that when the reels are synchronously rotated to retract or release the drawstrings, the drawstrings can be properly synchronously retracted or released, thereby effectively ensuring a stationarity of retracting or releasing of a curtain body connected to the drawstrings. By providing the cone segments on the reels, when the drawstring is wound on the cone segment to be retracted or released, the pulling force exerted on the reel will change correspondingly with the change of the lifting or falling height of the curtain body connected to the drawstring. However, the diameter at the stress point on the cone segment also changes synchronously, and the distal end of the drawstring is fixed to the fixing portion of the end of the reel away from the screw segment, thereby making the outer diameter of the stress force of the cone segment where the pulling force is relatively great is relatively less. By setting an appropriate taper, the moment of the drawstring acting on the cone segment can be relatively stable, so that the power mechanism having a constant torque output or a small torque variation interval can be used, and the cost of the power mechanism can be effectively reduced.

DETAILED DESCRIPTION OF THE INVENTION

Figure 1:
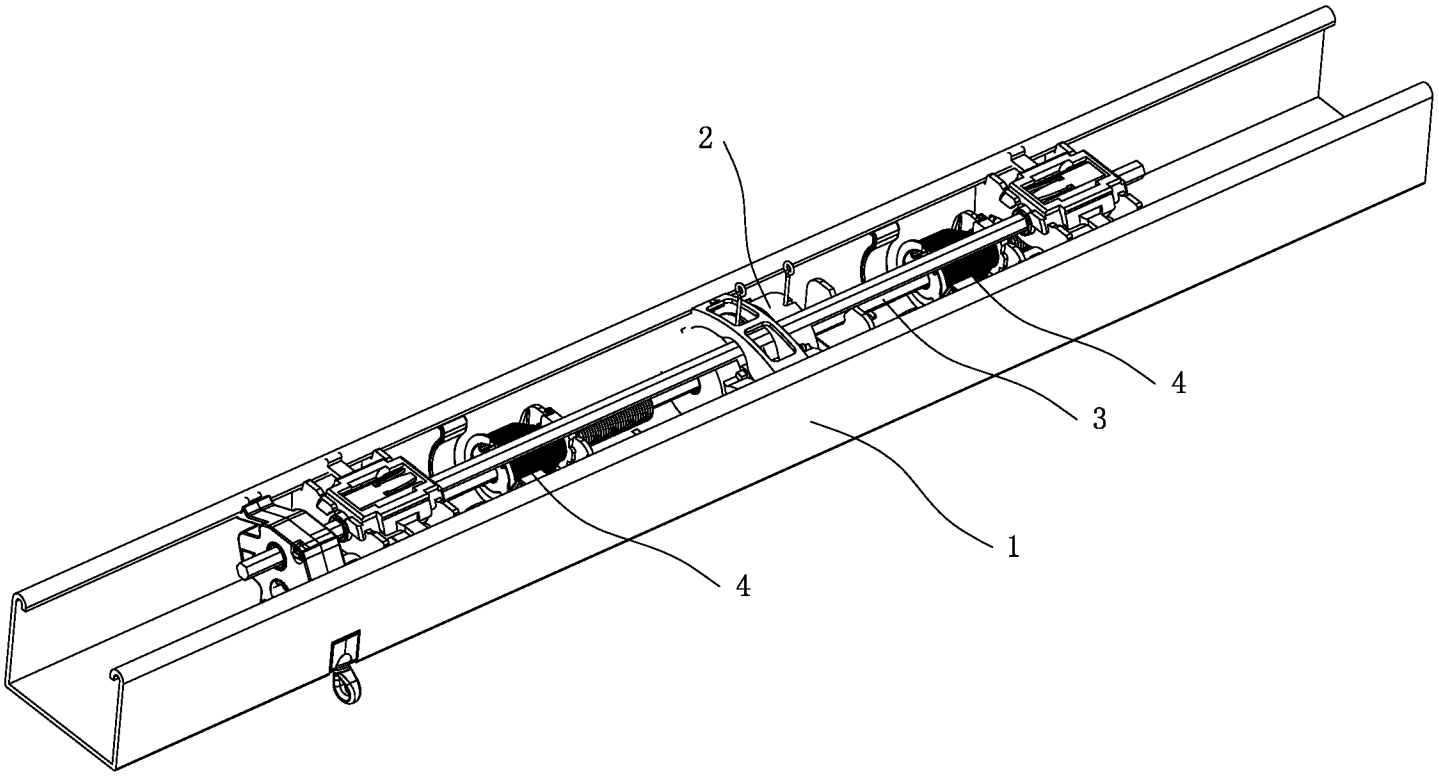
FIG. 1 is an isometric view of a curtain winding device an embodiment of the present invention, wherein the curtain winding device includes a reel.
Figure 2:
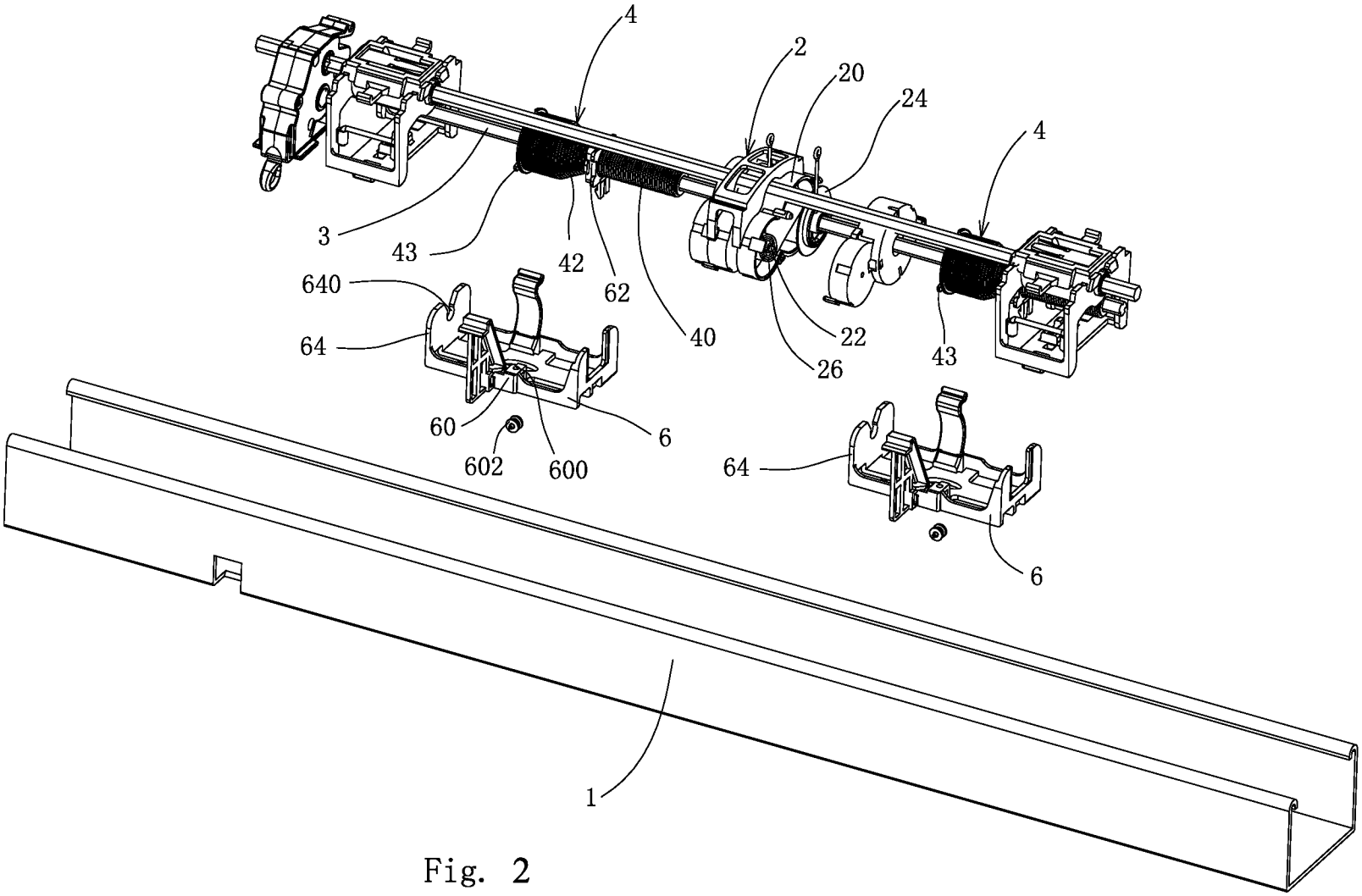
FIG. 2 is an exploded, isometric view of the curtain winding device of FIG. 1.
Figure 3:
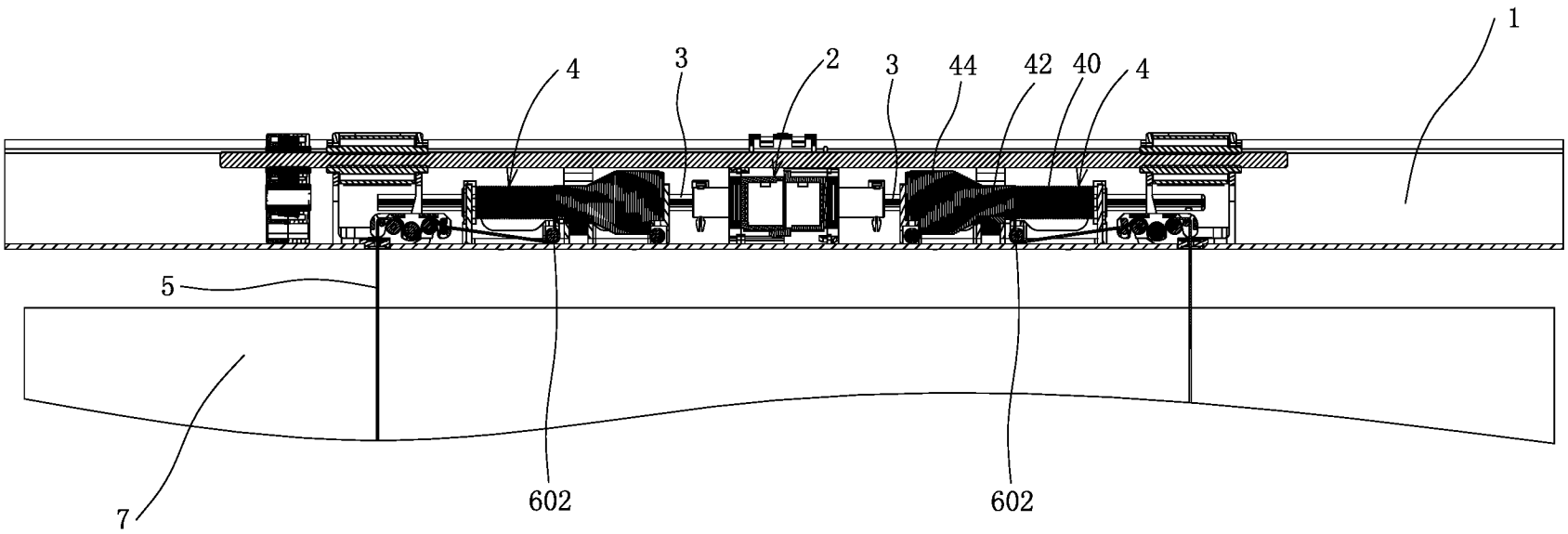
FIG. 3 is a cross-sectional view of FIG. 1, together with a curtain body.
Figure 4:
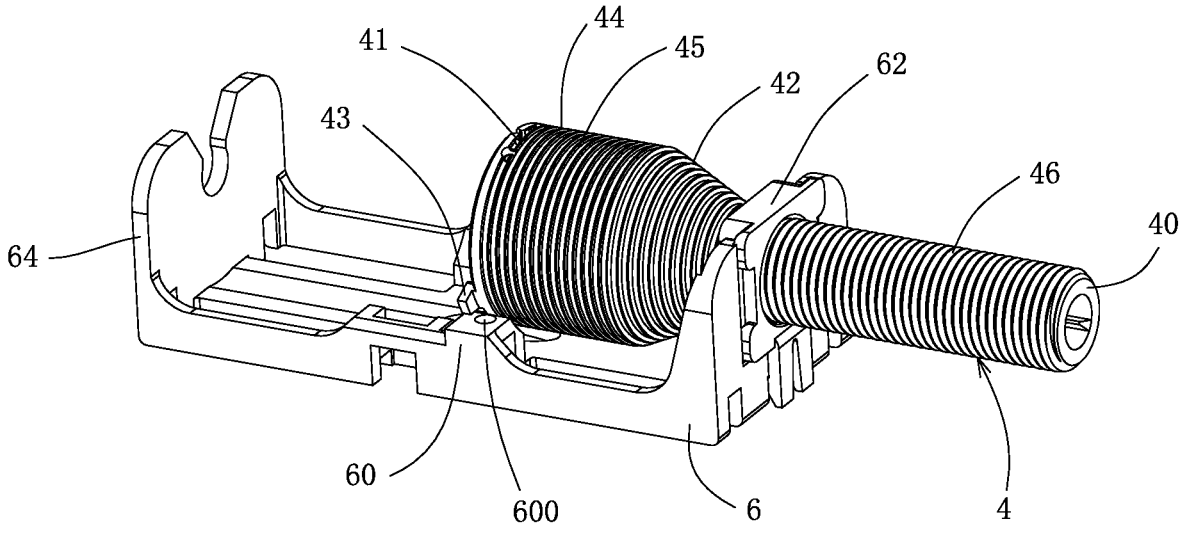
FIG. 4 is an isometric view of the reel of FIG. 1, showing the reel in an initial position.
Figure 5:
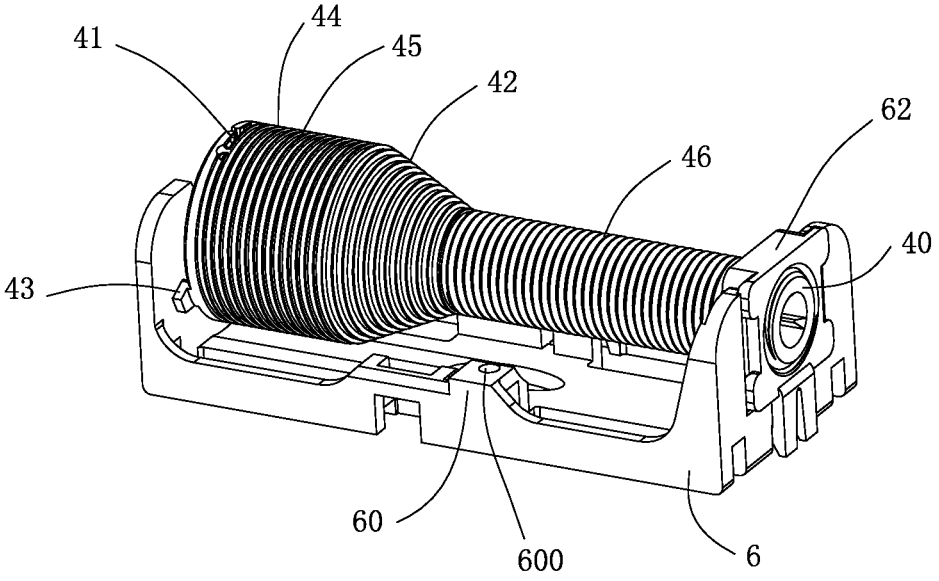
FIG. 5 is similar to FIG. 1, but showing the reel being abutted against a blocking plate.

The present application will be further described in detail below with reference to the accompanying drawings and specific embodiments. It should be understood that the following illustrative embodiments and illustrations are only used to explain the present invention and are not intended to limit the invention, and that the features of the embodiments and embodiments of the present application may be combined with each other.

Referring to FIGS. 1 through 6, an embodiment of a curtain winding device of the present disclosure includes a beam 1, a power mechanism 2 mounted to the beam 1, a transmission rod 3 driven by the power mechanism 2, and at least two reels 4 fitted about the transmission rod 3 and relatively fixed with the transmission rod 3 in the circumferential direction. A drawstring 5 is wound on each reel 4. A drawstring holder 60 is fixed to the beam 1 corresponding to each reel 4, to guide the drawstring 5 to be wound on the reel 4. A nut 62 is fixed to the beam 1, corresponding to each reel 4. The reel 4 includes a screw segment 40 screwed to the nut 62 on the beam 1, and a cone segment 42 extending from an end of the screw segment 40 and having an outer diameter gradually increasing in the extending direction. An end of the reel 4 away from the screw segment 40 is provided with a fixing portion 41 for fixing a distal end of the drawstring 5, and a positioning portion 43 protruding from an outer side surface of the reel 4 to be abutted against the drawstring holder 60 to position an initial position of the reel 4.

Figure 6:
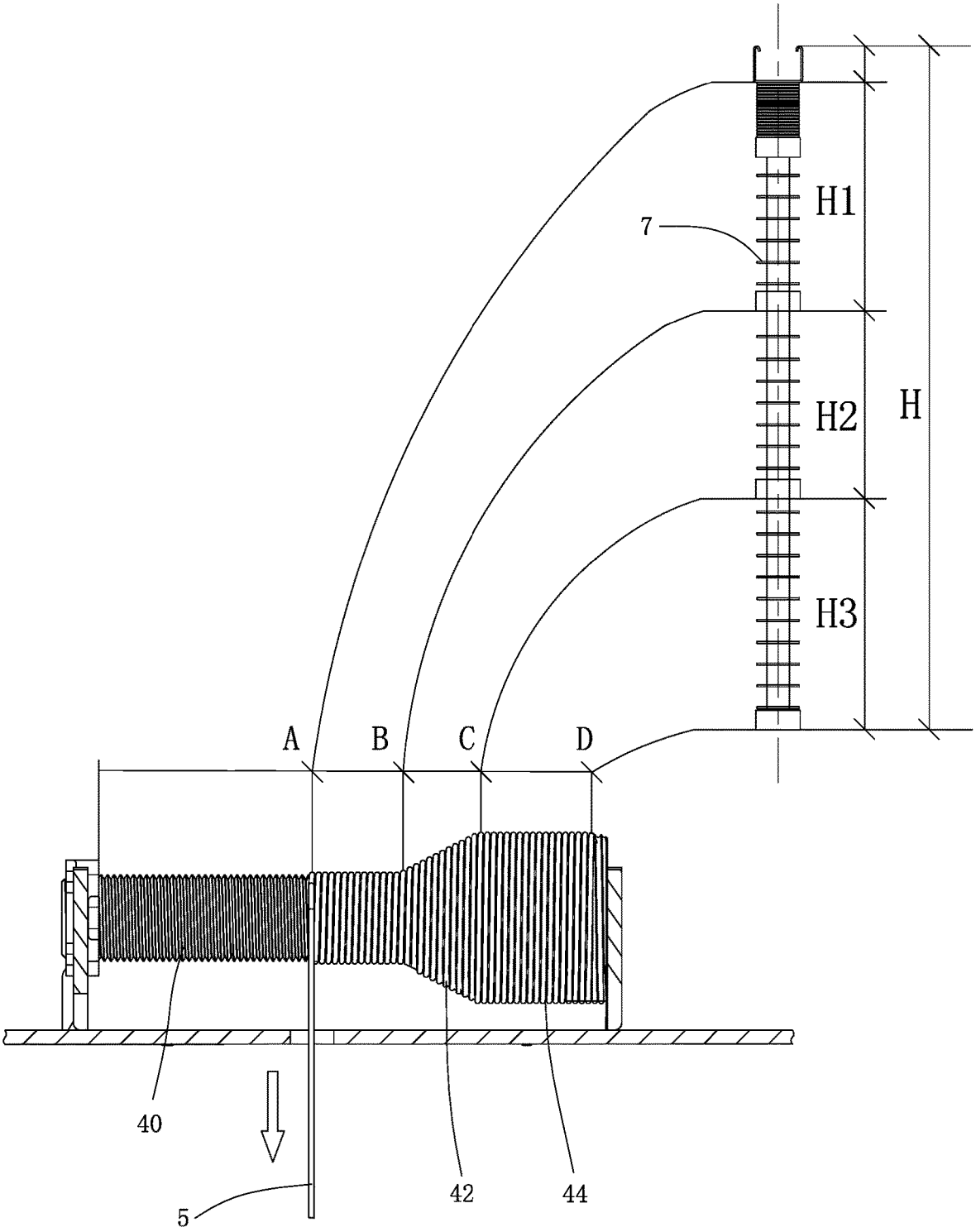
FIG. 6 is a plan, schematic view of FIG. 5, but showing the corresponding relationships between different positions of the reel and the positions of the lifting or falling height of the curtain body.

The curtain winding device provided by the embodiment of the present disclosure screws the reel 4 to the nut 62 fixed on the beam 1 through the screw segment 40. When the reel 4 is rotated by the driving force of the power mechanism 2 or an external pulling force, the reel 4 can move in the axial direction with respect to the nut 62, thereby causing the drawstring 5 to be retracted or released relative to the reel 4. The end of the reel 4 is further provided with the positioning portion 43, so that each reel 4 can be rotated to abut against the drawstring holder 60 through the positioning portion 43 at the time of assembly, thereby synchronizing the initial positions of the reels 4. On the basis of synchronizing the initial positions of the reels 4, the drawstrings 5 are further wound or unwound, and it can be ensured that when the reels 4 are synchronously rotated to retract or release the drawstrings 5, the drawstrings 5 can be properly synchronously retracted or released, thereby effectively ensuring a stationarity of retracting or releasing of a curtain body 7 connected to the drawstrings 5 within an entire lifting or falling height range (such as the height interval shown by H in FIG. 6). By providing the cone segments 42 on the reels 4, when the drawstring 5 is wound on the cone segment 42 (the BC section as shown in FIG. 6) to be retracted or released, the pulling force will change correspondingly with the change of the lifting or falling height of the curtain body 7 connected to the drawstring 5 (such as the height interval shown by H2 in FIG. 6). However, the diameter at the stress point on the cone segment 4 also changes synchronously, and the distal end of the drawstring 5 is fixed to the fixing portion 41 of the end of the reel 4 away from the screw segment 40, thereby making the outer diameter of the stress force of the cone segment 42 where the pulling force is relatively great is relatively less. By setting an appropriate taper, the moment of the drawstring 5 acting on the cone segment 42 can be relatively stable, so that the power mechanism 2 having a constant torque output or a small torque variation interval can be used, and the cost of the power mechanism 2 can be effectively reduced.

In an embodiment of the present disclosure, the reel 4 further includes a straight segment 44 extending from an end of the cone segment 42 away from the screw segment 40. Each outer diameter of the straight segment 44 is equal to a maximum outer diameter of the cone segment 42. The fixing portion 41 and the positioning portion 43 are both disposed at an end of the straight segment 44 away from the cone segment 42. In the embodiment, the straight segment 44 extends from the distal end of the cone segment 42 and has the outer diameter equal to the maximum outer diameter of the cone segment 42, and the fixing portion 41 is disposed at the distal end of the straight segment 44. Therefore, when the drawstring 5 is wound on the straight segment 44 (the CD section as shown in FIG. 6), the curtain body 7 is unfolded to a relatively low position, as shown by the height interval shown by H3 in FIG. 6, and at this time, the pulling force exerted on the reel 4 by the drawstring 5 is relatively less and the rate of change of the pulling force is not great. Therefore, although it is a straight segment 44 having the same outer diameter, it can still support the curtain body 7 more stably, and the same outer diameter is also convenient to manufacture.

In an embodiment of the present disclosure, the outer surfaces of the straight segment 44 and the cone segment 42 are integrally connected to form a first external thread 45. The first external thread 45 is connected to a second external thread 46 formed on the outer surface of the screw segment 40 and screwed to the nut 62. After the drawstring 5 is fixed to the fixing portion 41 through the distal end, the drawstring 5 is wound on the reel 4 along threaded grooves 450 and 460 of the first thread 45 and the second thread 46. In the embodiment, the first external thread 45 is formed on the outer surfaces of the straight segment 44 and the cone segment 42, and is connected to the second thread 46 of the screw segment 40. The drawstring 5 can be well guided along the threaded grooves 450 and 460 to be wound on the reel 4, which avoids chaotic winding of the drawstring 5, and which better ensures the stationarity of the lifting or lowering of the curtain body 7. When the drawstring 5 is wound on the second thread 46 of the screw segment 40 (the CD section as shown in FIG. 6), correspondingly, the curtain body 7 is pulled up to be a relatively high position, as shown by the height interval shown by H1 in FIG. 6. At this time, the pulling force exerted on the reel 4 by the drawstring 5 is relatively great and the rate of change of the pulling force is less. Therefore, even though the drawstring 5 is wound on the screw segment 40 having the same outer diameter, the drawstring 5 can still support the curtain body 7 stably.

In another embodiment, the beam 1 is fixed with a base 6 one-to-one correspondence with the reel 4. Opposite ends of the base 6 are respectively fixed with the nut 62, and a blocking plate 64 for defining an axial movement stroke of the reel 4. The reel 4 is disposed between the nut 62 and the blocking plate 64, in parallel with the base 6, and is screwed to the nut 62 through the screw segment 40. In the specific implementation, the nut 62 can be fixed to an end of the base 6 through a snap-fit structure. In the embodiment, the base 6 is disposed on the beam 1 in one-to-one correspondence with the reel 4, and the nut 62 is fixed to the base 6. The assembly effect can be effectively improved. By providing the blocking plate 64 on the base 6 to define the axial movement stroke of the reel 4, it is possible to prevent the screw segment 40 of the reel 4 from being completely detached from the nut 62, and the reel 4 can be ensured to always rotate normally to realize retracting or releasing the drawstring 5.

In another embodiment of the present disclosure, a middle of the base 6 is provided with the drawstring holder 60. The drawstring holder 60 protrudes toward the reel 4 with respect to the middle of the base 6. The drawstring holder 60 is provided with a drawstring hole 600 through which the drawstring 5 extends, and a drawstring wheel 602 that guides an extending direction of the drawstring 5. In the embodiment, the drawstring holder 60 is disposed on the base 6, so that assembly can be further facilitated. The drawstring holder 60 protrudes toward the reel 4 with respect to the middle of the base 6, so that the positioning portion 43 can be effectively abutted against the drawstring holder 60.

In an embodiment of the present disclosure, the blocking plate 64 further defines a passage 640 through which the transmission rod 3 extends. In the embodiment, the blocking plate 64 defines the passage 640 for the transmission rod 3 extending through, so that the connection fit of the transmission rod 3 and the reel 4 does not be affected.

In an embodiment of the present disclosure, the thickness of the positioning portion 43 in the axial direction of the reel 4 and the abutting position of the positioning portion 43 on the drawstring holder 60 are set such that the positioning portion 43 and the drawstring holder 60 are displaced from each other after the reel 4 is rotated one rotation from the initial position. By adopting such a design, when the reel 4 is rotated from the initial position in a first direction, the positioning portion 43 does not abut against the drawstring holder 60, that is, the drawstring holder 60 will not interfere with the normal rotation of the reel 4. When the reel 4 is reversely rotated back to the initial position, the positioning portion 43 can effectively abut against the drawstring holder 60 to prevent the reel 4 from excessively rotating, so that the reel 4 is accurately held at the initial position, thereby effectively protecting the positional synchronization of each reel 4.

In another embodiment of the present disclosure, the power mechanism 2 includes a housing 20, a spring shaft 22 and an output shaft 24 rotatably disposed in the housing 20 in parallel with each other, and a scroll spring 26 that is wound on the spring shaft 22 and has an outer end fixed to the output shaft 24 to output a constant torque. The output shaft 24 and the transmission rod 3 are in drive connection. In the embodiment, by using the scroll spring 26 that outputs the constant torque, the cost of the power mechanism 2 can be effectively reduced.

The specific embodiments described above further explain the objectives, technical solutions, and beneficial effects of the present invention. It is to be understood that the foregoing description is only specific embodiments of the present invention, and is not intended to limit the scope of the present invention. Any modifications, equivalent substitutions, improvements made within the spirit and scope of the present invention are intended to be included in the scope of the present invention.

What is claimed is:

1. A curtain winding device, comprising:

a beam;

a power mechanism mounted to the beam;

a transmission rod driven by the power mechanism to rotate;

two drawstrings;

two reels fitted about the transmission rod and relatively fixed with the transmission rod in a circumferential direction, wherein the drawstrings are wound on the reels, respectively; and two bases fixed to the beam, corresponding to the reels, respectively, wherein the reels are rotatably mounted to the bases;

wherein a respective drawstring holder extends up from a respective side of each of the bases, to guide the respective drawstring to be wound on the respective reel, each of the drawstring holders is arranged side by side with the corresponding reel, and is parallel to an axial direction of the corresponding reel;

wherein a respective nut is fixed to a respective end of each of the bases, corresponding to the respective reel; each of the drawstring holders comprises a top surface defining a drawstring hole therein, a corresponding one of the drawstrings extends up through the drawstring hole to be wound on the corresponding reel, the top surface is higher than a bottom of a corresponding one of the reels;

wherein each of the reels comprises a screw segment screwed to the corresponding nut, a cone segment extending from an end of the screw segment and gradually increasing in an outer diameter along an extending direction, and a straight segment extending from an end of the cone segment away from the screw segment; an outer diameter of the straight segment is equal to a maximum outer diameter of the cone segment; an end of the straight segment away from the screw segment is provided with a fixing portion for fixing a distal end of the corresponding drawstring, and a positioning portion that protrudes from an outer side surface of the end of the straight segment;

wherein each of the drawstring holders is located between a corresponding one of the nuts and the positioning portion of a corresponding one of the reels; wherein in an initial position of each of the reels, the positioning portion is abutted against the top surface of the corresponding drawstring holder, the top surface applies a resistance on the positioning portion in the circumferential direction of the corresponding reel to prevent the corresponding reel from rotating, thereby to position the corresponding reel; and wherein outer surfaces of the straight segment and the cone segment are integrally connected to form a first external thread, the first external thread is connected to a second external thread formed on an outer surface of the screw segment and screwed to the corresponding nut; wherein after the corresponding drawstring is fixed to the fixing portion through the distal end, the corresponding drawstring is wound on the corresponding reel along threaded grooves of the first external thread and the second external thread.

2. The curtain winding device of claim 1, wherein a blocking plate extends up from an opposite end of each of the bases, for defining an axial movement stroke of the corresponding reel, together with the corresponding nut; the corresponding reel is disposed between the corresponding nut and the corresponding blocking plate, and the corresponding positioning portion is located between the corresponding blocking plate and the corresponding drawstring holder.

3. The curtain winding device of claim 1, wherein a thickness of the corresponding positioning portion in the axial direction of each reel and an abutting position of the corresponding positioning portion on the corresponding drawstring holder are set such that the corresponding positioning portion and the corresponding drawstring holder are displaced from each other after the corresponding reel is rotated one rotation from the initial position.

4. The curtain winding device of claim 1, wherein the power mechanism includes a housing, a spring shaft and an output shaft rotatably disposed in the housing in parallel with each other, and a scroll spring that is wound on the spring shaft and has an outer end fixed to the output shaft to output a constant torque; the output shaft and the transmission rod are in drive connection.

5. The curtain winding device of claim 2, wherein a drawstring wheel that guides an extending direction of the drawstring is mounted below the top surface of each of the drawstring holders.

6. The curtain winding device of claim 2, wherein the corresponding blocking plate defines a passage through which the transmission rod extends.

* * * * *